US005318345A

United States Patent [19]

Olson

[11] Patent Number: 5,318,345

[45] Date of Patent: Jun. 7, 1994

[54] TILT BACK CHAIR AND CONTROL

[75] Inventor: Ogden R. Olson, Muscatine, Iowa

[73] Assignee: Hon Industries, Inc., Muscatine, Iowa

[21] Appl. No.: 712,085

[22] Filed: Jun. 7, 1991

[51] Int. Cl.[5] ..... A47C 1/032

[52] U.S. Cl. ..... 297/301

[58] Field of Search ..... 297/301, 300, 304

[56] References Cited

U.S. PATENT DOCUMENTS

| | | | |
|---|---|---|---|
| 2,441,251 | 5/1948 | Raitch . | |
| 2,859,799 | 11/1958 | Moore | 297/301 |
| 3,072,436 | 1/1963 | Moore . | |
| 3,329,463 | 7/1967 | Zimmermann . | |
| 3,356,414 | 12/1967 | Doerner . | |
| 3,578,379 | 5/1971 | Taylor et al. . | |
| 4,131,260 | 12/1978 | Ambasz . | |
| 4,200,332 | 4/1980 | Bräuning . | |
| 4,390,206 | 6/1983 | Faiks et al. . | |
| 4,429,917 | 2/1984 | Diffrient . | |
| 4,432,582 | 2/1984 | Weismann et al. . | |
| 4,502,729 | 3/1985 | Locher | 297/301 |
| 4,537,445 | 8/1985 | Neuhoff . | |
| 4,603,905 | 8/1986 | Stucki . | |
| 4,685,730 | 8/1987 | Linguanotto . | |
| 4,707,028 | 11/1987 | Gamberini . | |
| 4,718,725 | 1/1988 | Suhr et al. . | |
| 4,720,142 | 1/1988 | Holdredge et al. . | |
| 4,758,045 | 7/1988 | Edel et al. . | |
| 4,761,033 | 8/1988 | Lanuzzi et al. . | |
| 4,765,679 | 8/1988 | Lanuzzi et al. . | |
| 4,773,706 | 9/1988 | Hinrichs . | |
| 4,776,633 | 10/1988 | Knoblock et al. . | |
| 4,848,837 | 7/1989 | Völkle . | |
| 4,966,411 | 10/1990 | Katagiri et al. | 297/301 |
| 4,966,412 | 10/1990 | Dauphin . | |
| 4,986,601 | 1/1991 | Inoue | 297/301 |

FOREIGN PATENT DOCUMENTS

| | | |
|---|---|---|
| 0242140 | 4/1986 | European Pat. Off. . |
| 8614185 | 5/1986 | European Pat. Off. . |
| 0237825 | 3/1987 | European Pat. Off. . |

*Primary Examiner*—Peter R. Brown

*Attorney, Agent, or Firm*—Jones, Day, Reavis & Pogue

[57] ABSTRACT

A tiltable chair has a base, a vertical post, a seat, a back and a chair control. The chair control comprises a housing attached to the vertical post, a resilient biasing means mounted in the stationary housing for biasing the chair in an upright position, a seat support structure, a back support structure and a back frame member. The seat support structure is pivotally connected to the housing at a pivot axis aligned over the vertical post. The back support structure is pivotally connected to the seat support structure at an axis forward of the vertical post. One end of the back frame member supports the back support structure while a mid-portion is interconnected to the seat support structure and the opposite end is pivotally attached to the housing to provide both differential tilting of the seat and back and correlated differential vertical movement for ergonomic comfort and to avoid "shirt pull." A spring mount assembly comprising compression springs compressed between the front portion of the seat and the seat support structure provides resilient but flexible seat support. A base cover assembly comprises top and bottom fairings which form a friction fit with the base and which also snap fit together to provide a smooth, attractive appearance.

31 Claims, 12 Drawing Sheets

Fig. 14
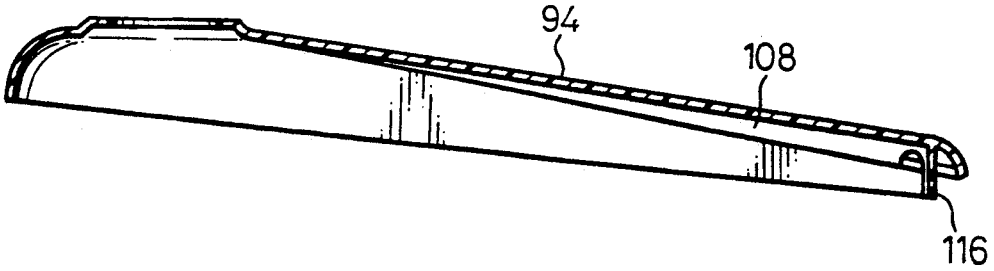
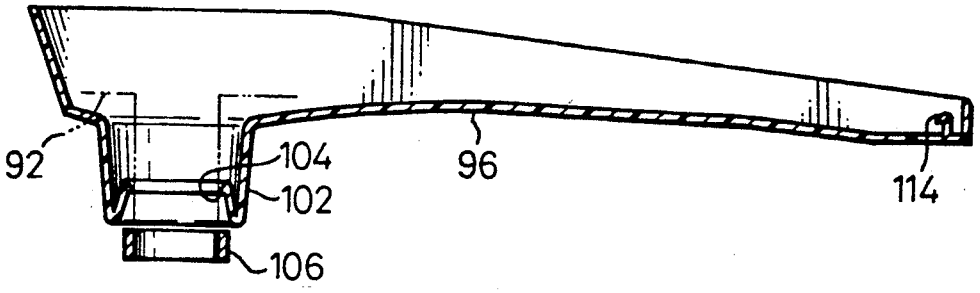
Fig. 15

TILT BACK CHAIR AND CONTROL

FIELD OF THE INVENTION

This invention relates to tilt back chairs of the type having a back, a seat, and a base. More particularly, this invention relates to an improved chair and control suitable for office and other environments.

BACKGROUND OF THE INVENTION

A number of attempts have been made to provide a simple, reliable chair and control which allows the chair to move in tune with the user's movement, and also alleviate the problem of "shirt pull" found in many conventional chairs. "Shirt pull" occurs in chairs which, when a user tilts the chair rearwardly, the chair back moves longitudinally up the user's back, pulling up the user's shirt from its normal retention at the waist.

An additional problem occurs in chairs in which the back and seat tilt at substantially the same rate, that is, where the degree of back tilt and seat tilt are substantially the same. In such chairs, as the user leans back, the front portion of the seat exerts upward force on the back of the user's upper legs which can be uncomfortable and even impair blood circulation through the user's legs. Furthermore, if too much of the user's weight is shifted backward, the user can lose stability.

It is therefore desirable to have a chair in which the back and seat tilt separately. More particularly, it is desirable to have a chair in which, as the user leans back, the degree of back tilt is significantly greater than the degree of seat tilt.

It is also desirable that the seat provide independent flexibility of support for the user, particularly at the front portion of the seat, to further accommodate the user in various typical body positions. The seat should accommodate, for example, the user shifting left and right, straightening one leg more than the other, or extending both legs, without putting undue localized pressure on the user's legs. To these ends, the seat should allow torsional (left-right) flexing of the front portion of the seat, as well as vertical resilience of the front portion for fore-and-aft pitch flexibility.

Further it is desirable to provide a finished, integrated and smooth surfaced pedestal and support structure.

While chairs have been proposed previously toward accomplishing the various noted characteristics, it is desirable to obtain improved designs which provide these desirable characteristics in an efficacious manner and which can be produced economically.

The present invention achieves differential tilt, that is, a greater degree of back tilt to seat tilt, in a chair having separate back and seat supports. The chair control mechanism is designed to allow for movement of the chair back and seat in concert with the user's natural body seating and semi-reclining movements, while alleviating the problem known as "shirt pull" found in many prior art chairs. It also provides both torsional and vertical yieldability of the front portion of the seat to further comfortably accommodate various typical user body positions.

A further advantage of the preferred embodiment as illustrated is that it can be economically manufactured by modifying existing chair tilt control mechanisms, e.g., a known control available from Faultless Caster of Evansville, Ind.

OBJECTS OF THE INVENTION

It is therefore an object of this invention to provide improved chair designs which attain the aforestated desirable characteristics.

It is a further object of the invention to provide an improved chair in which the back and seat tilt at separate rates.

It is a still further object of the invention to provide an improved chair control which provides controlled back tilt greater than the degree of seat tilt.

Another object of the invention is to provide a chair which alleviates or eliminates the common problem known as "shirt pull."

Still another object of the invention is to provide a chair that moves in concert with the user's natural movements.

Yet another object of the invention is to provide a chair that is relatively easy to manufacture yet attractive in appearance.

Further and additional objects will appear from the description, accompanying drawings, and appended claims.

SUMMARY OF THE INVENTION

The foregoing and other objects are achieved by a chair having a base, a vertical post supported by the base, a chair seat having a rear portion and a front portion, a chair back and a chair control. The chair control comprises a housing pivotally attached to the vertical post to remain in a predetermined normally horizontal plane, a resilient biasing means mounted in the housing, a seat support structure, a back support structure and a back frame member, or flipper. The seat support structure, sometimes referred to as the spider, is connected to and supports the chair seat. The seat support structure is pivotally attached to the housing at a horizontal axis substantially vertically aligned with the vertical post.

The back support structure, also referred to as the back upright assembly, is connected to and supports the chair back. The back support structure is pivotally connected to the seat support structure at a horizontal axis forward of the vertical post.

One end of the flipper supports the back support structure. In the preferred embodiment, a bearing means is attached to the back support structure and is matingly engaged with the flipper so that the bearing means can slide across a surface of the flipper as the user leans back and forth. The other end of the flipper is pivotally attached to the stationary housing. A rear portion of the seat support is connected to a mid-portion of the flipper. Thereby the flipper correlates the tilt of the seat and of the back, providing substantially greater angular movement and displacement of the back than of the seat.

The resilient biasing means, preferably a torsion spring, biases the chair in an upright, or untilted, position. In the preferred embodiment, the torsion spring comprises front and rear portions extending substantially perpendicular to the torsional axis. The rear portion of the spring is in contact with the flipper and exerts an upward force on the flipper which biases the chair in an upright position. The front portion of the spring is engaged and held by a tension adjustment bolt.

The chair also comprises a spring mount assembly for providing resilient support to the front portion of the seat. The spring mount assembly preferably comprises a pair of compression springs engaged under compression between the underside of the chair seat and the seat support structure.

The back support structure preferably comprises a pair of substantially vertical members, a horizontal member interposed between the vertical members, and a pair of substantially parallel horizontal extension arms attached to the ends of the substantially parallel vertical members. The bearing means is attached to the horizontal cross member.

The base of the chair is covered by a base cover assembly comprising a bottom base cover and a top base cover. The bottom base cover comprises a central portion and a plurality of arms extending radially therefrom in registry with the radial legs of the base. Each arm has an upwardly extending tab for engaging the top base cover. The central portion has a generally cylindrical shape defining a generally cylindrical interior and includes a radially inwardly extending protrusion which reduces the cross sectional area of the interior to provide a friction fit between the bottom base cover and the base.

A rubber ring fits into the space between the base hub and the bottom base cover and provides a second friction lock.

The top base cover has a central portion and a plurality of arms extending radially therefrom. Each arm has a downwardly extending slotted tongue which, upon assembly, accommodates a corresponding upwardly extending tab on each leg of the bottom base cover to provide a snap fit between the top and bottom base covers at the outer end of each leg. The top base cover also comprises downwardly extending planar surfaces which help locate the top base cover in relation to the base. The central portion of the top base cover comprises a generally circular opening for accommodating the base. The central portion includes tabs extending radially inwardly from the perimeter of the circular opening to provide a friction fit between the top base cover and the base.

BRIEF DESCRIPTION OF THE DRAWINGS

For a more complete understanding of the invention reference is made to the drawings where:

FIG. 14 is a sectional view of the top base cover of FIG. 12, taken along section 14—14 of FIG. 12.

FIG. 15 is a sectional view of the bottom base cover of FIG. 13, taken along section 15—15 of FIG. 13.

DETAILED DESCRIPTION OF THE INVENTION

Figure 1:
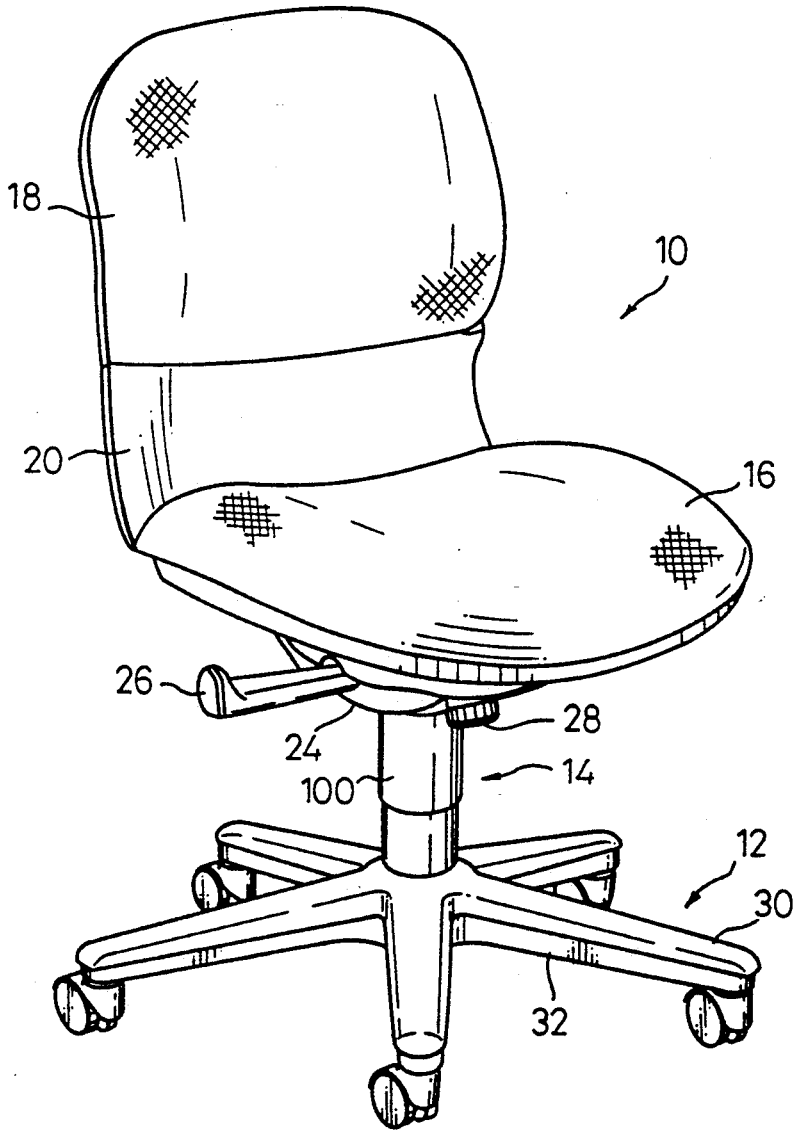
FIG. 1 is a front perspective view of a chair embodying the present invention.

Referring first to FIG. 1 of the drawings, a chair 10 embodying the present invention is shown. The chair includes a base 12, a vertical support post or pedestal 14 supported by the base 12, a seat 16 and a back 18. A lower back member 20 is interposed between the back 18 and seat 16. The chair control mechanism, designated generally as 22 and shown in FIGS. 2–9, is located beneath the seat 16 and is hidden from view in FIG. 1 by the seat and by bottom cover panel 24. A lever handle 26 engages a height adjustment lever 27 which extends radially from vertical post 14 and can be manipulated by the user to adjust the height of the chair. A tension adjustment knob 28 can be manipulated by the user to adjust the tension applied to the tilt control, thus increasing or decreasing the resistance to tilt of the chair back and seat relative to the base. A tilt lock lever 29, shown in FIG. 10, can be manipulated by the user to place the tilt control mechanism in a locked or unlocked position.

The base 12 comprises a top base cover 30 and a bottom base cover 32 which fit together to form a smooth attractive surface in a manner explained in greater detail below.

Figure 8:
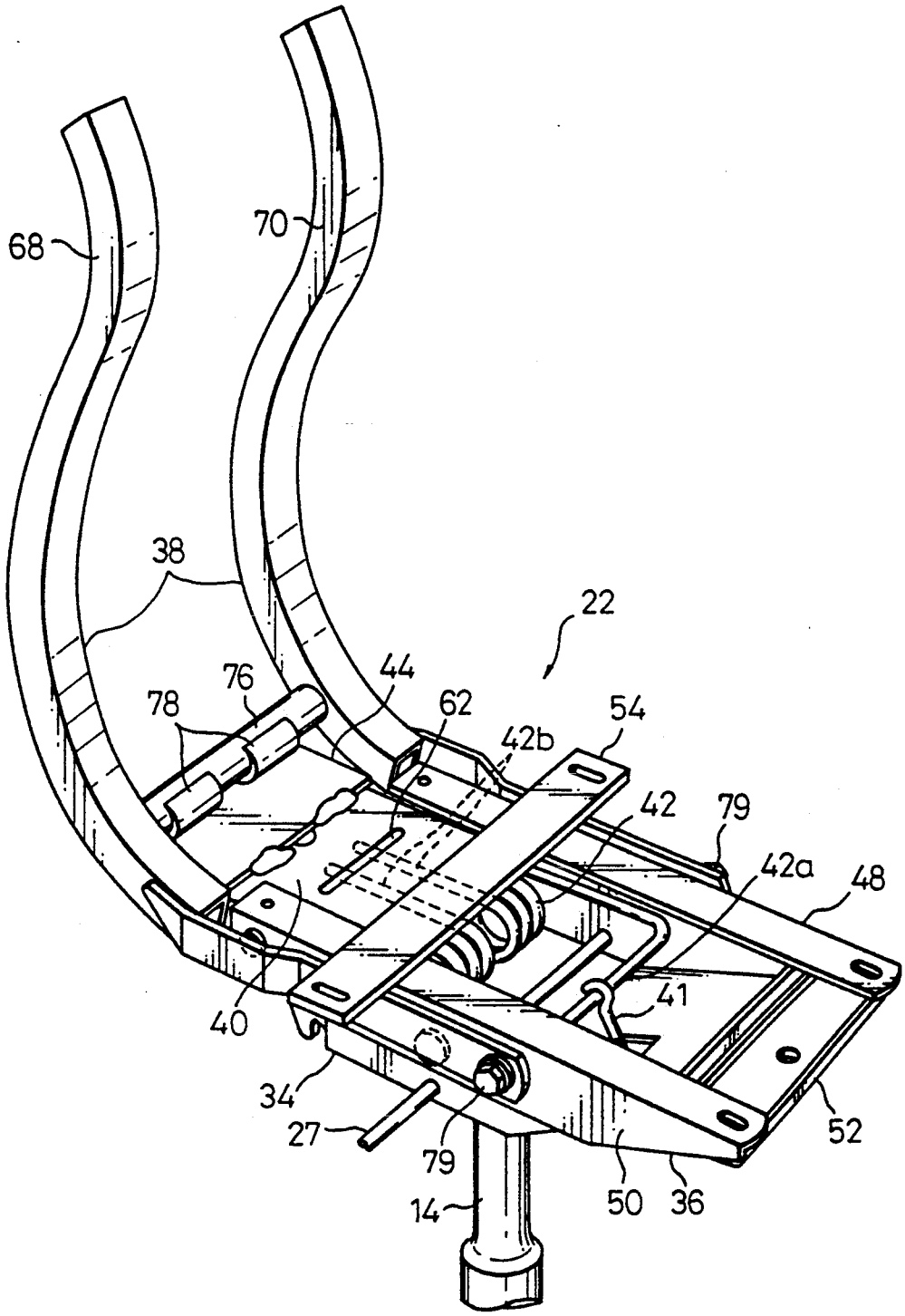
FIG. 8 is a front perspective view of a chair control mechanism as in FIG. 2.
Figure 9:
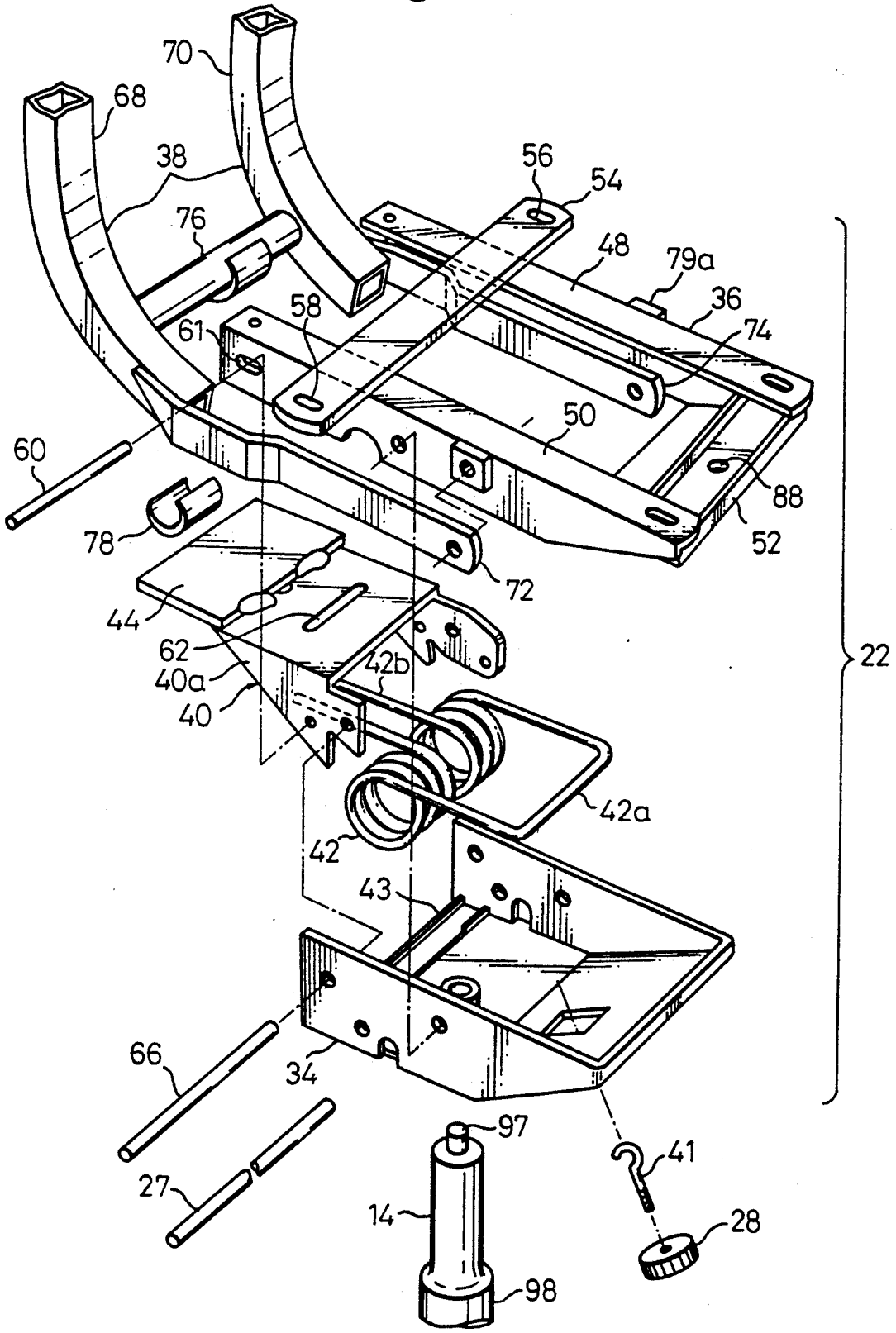
FIG. 9 is an exploded perspective view of a chair control mechanism as in FIG. 2.

The chair control mechanism 22 comprises a housing 34 pivotally attached in a fixed horizontal position on the vertical post 14, a seat support structure 36, a back support structure 38 and a back frame member or flipper 40. A resilient biasing means 42, comprising a coil spring as best shown in FIGS. 8 and 9, is mounted in the stationary housing 34 and biases the control toward maintaining the chair seat and back in an upright (untilted) position. A J-shaped tension bolt 41 engages a front portion **42*a* of the spring, projects through an opening in housing 34, and is adjusted by knob 28 for tension control of the spring 42**.

Figure 2:
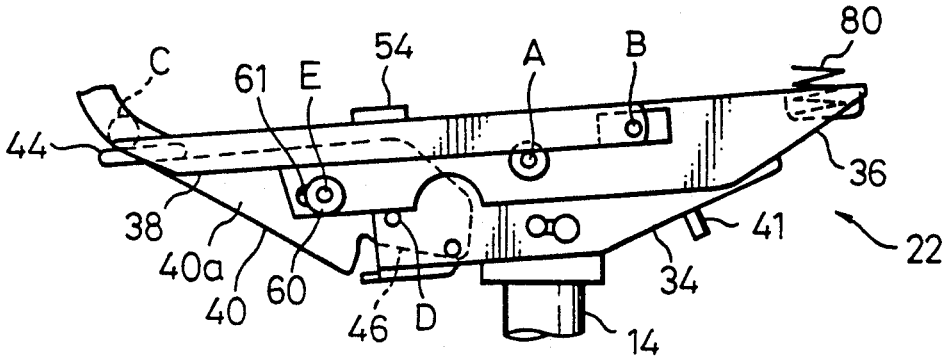
FIG. 2 is a side elevational view of a chair control mechanism embodying the present invention, shown in an untilted position with part of the back support structure cut away.
Figure 3:
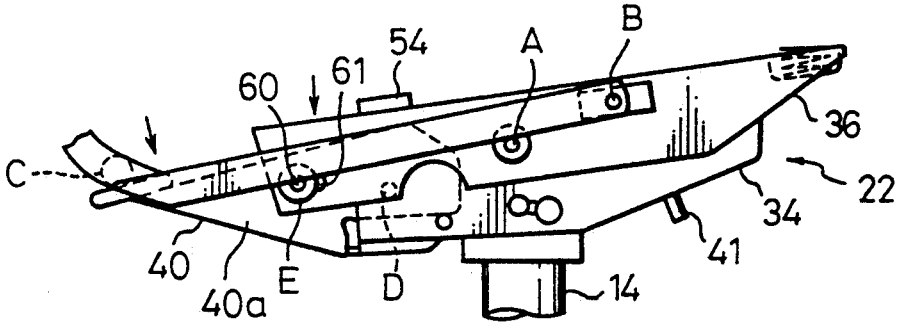
FIG. 3 is a side elevational view of the chair control mechanism of FIG. 2 in a tilted position.

The seat 16 is mounted on and supported by the seat support structure 36. As FIG. 2 shows, and as described further below, the seat support structure 36 is pivotally attached to the stationary housing 34 at horizontal axis A, which is substantially aligned over the vertical post 14.

Figure 4:
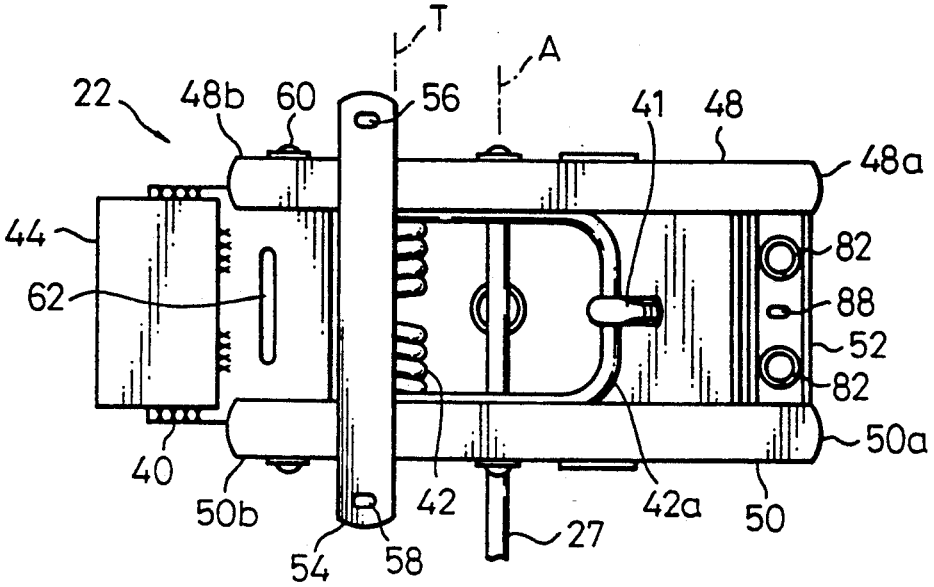
FIG. 4 is a top elevational view of a chair control mechanism as in FIG. 2, with the back support removed.
Figure 5:
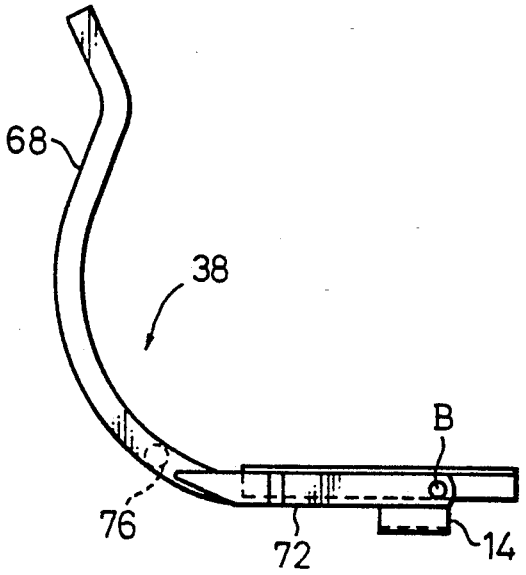
FIG. 5 is a side elevational view of a back support structure as in FIG. 2.
Figure 6:
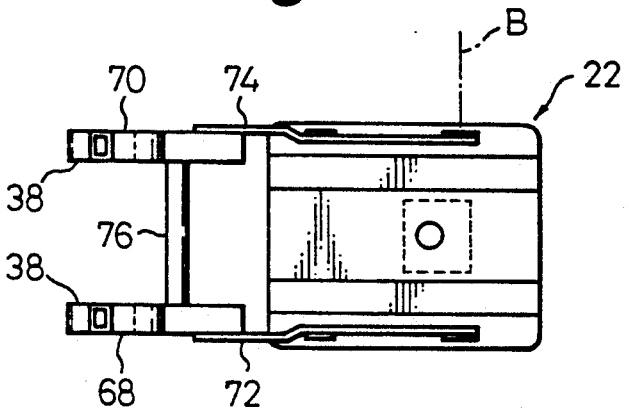
FIG. 6 is a bottom view of a chair control mechanism as in FIG. 2.

Referring particularly to FIGS. 4, 8 and 9, the seat support structure 36 comprises two substantially parallel horizontal members 48, 50 having front portions **48*a*, 50*a* and rear portions 48*b*, 50*b* (see FIG. 4). The front portions refer to those portions forward of the seat pivot axis A, and the rear portions refer to those portions rearward of the seat pivot axis A. A member 52, which is U-shaped in cross-section, extends between and connects the front portions 48a, 50a of the horizontal members 48, 50. A flat rigid horizontal cross member 54 is fixedly attached to the rear portions 48b, 50b of the horizontal members 48, 50. The cross member 54 has holes 56, 58 for receiving bolts (not shown) for securing the rear portion of the seat 16 to the seat support structure 36**.

The chair back 18 is mounted on and supported by the back support structure 38. The back support structure 38 is pivotally attached to the seat support structure 36 at axis B which is forward of the vertical post 14.

The back support structure 38 comprises two substantially parallel vertical members 68, 70 and two substantially parallel horizontal members or extension arms 72, 74.

A horizontal member 76 (FIG. 8) connects the vertical members 68, 70. The horizontal member 76 provides strength and support to the back support structure 38 and also provides a place to attach the bearing pad means 78. The back support structure 38 is pivotally attached to the seat support structure 36 on a pair of pivot studs 79 which are threaded into nuts 79a that are welded to the sides of the seat support structure 36 (see FIG. 9) at a transverse horizontal axis B located forward of the vertical post 14 to be approximately beneath (in vertical alignment with) the hip joints of a user when in a normal seated position on the chair. The rear portion of the back support structure 38 is supported by the flipper 40 at the sliding interface of the bearing means 78 and the back plate 44 of the flipper 40.

The flipper 40 comprises a plate 44 at one end for supporting the back support structure 38 at sliding interface C. In this embodiment, the support plate 44 is an extension of the flipper 40 such as by being welded thereto. The opposite end 46 of the flipper 40 is pivotally attached to the housing 34 at pivot axis D by flipper pivot pin 66 (FIG. 9). The flipper is also attached to the seat support structure 36 at slidable pivot connection E in the mid-portion of the flipper. An axle pin 60 extends through openings in side flanges 40a of the flipper 40 and through slots 61 in the seat support structure 36 (best shown in FIGS. 2 and 3) to secure the flipper 40 to the seat support structure 36 in such a slidable interconnection. This provides a vertical two-way support and load transfer interconnection and interrelation between the tiltable seat support 36 and the tiltable back support structure 38.

The torsion spring 42 rests on a shallow channel "nest" plate 43 which is welded inside the housing 34. The spring comprises a coil portion with front arms 42a and rear arms 42b (shown in FIGS. 8 and 9) extending substantially perpendicular to the torsional axis, designated by a T in FIG. 4. The rear arms 42b of the torsion spring 42 are in contact with a downwardly embossed rib 62 and thereby exert an upward force on the rear portion of the flipper 40. The front arm portion 42a of the torsion spring 42 is engaged and held by the tension adjustment bolt 41.

The height adjustment lever 27, shown in FIG. 4, is pivotally supported in one side of the stationary housing 34 and engages a control button 97 at the top of vertical post 14 for selective operation of the pneumatic gas cylinder 98 for adjusting the height of the chair seat 16 in a known manner.

Figure 7:
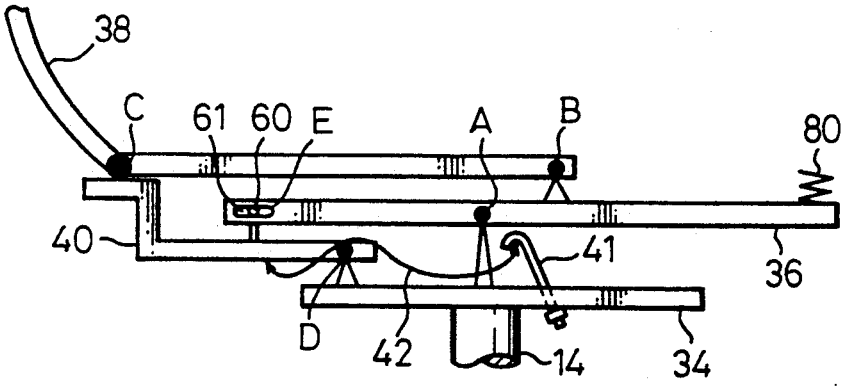
FIG. 7 is a schematic illustration of a chair control mechanism according to the present invention, with the chair in an upright position.

FIG. 7 is a schematic illustration of a chair control mechanism according to the present invention, with the chair shown in an upright position. Seat pivot axis A is shown as being substantially in alignment over vertical post 14. Back support structure pivot axis B is forward of vertical post 14. The back support structure 38 is supported at C by one end of the flipper 40. The opposite end of the flipper 40 is pivotally attached to the stationary housing 34 at axis D. The flipper 40 is also connected to the seat support structure 36 by slidable connection E. The torsion spring 42, shown schematically, exerts an upward force on the flipper 40 at a location rearward of axis D and thereby biases both the seat and the back to their forward or "upright" position.

FIG. 9 provides an exploded perspective view of the chair control mechanism 22. FIG. 9 clearly illustrates the manner in which the horizontal members 72, 74 of the back support structure 38 may be connected to the vertical members 68, 70. While the horizontal members 72, 74 are shown welded to the vertical members 68, 70 in the illustrated embodiment, other means for connecting the horizontal members to the vertical members are anticipated, such as bolting the horizontal members to the vertical members, or by making each pair of horizontal and vertical members out of one piece of material. Similarly it will be appreciated that various means of assembly and attachment may be utilized for other components.

Figure 10:
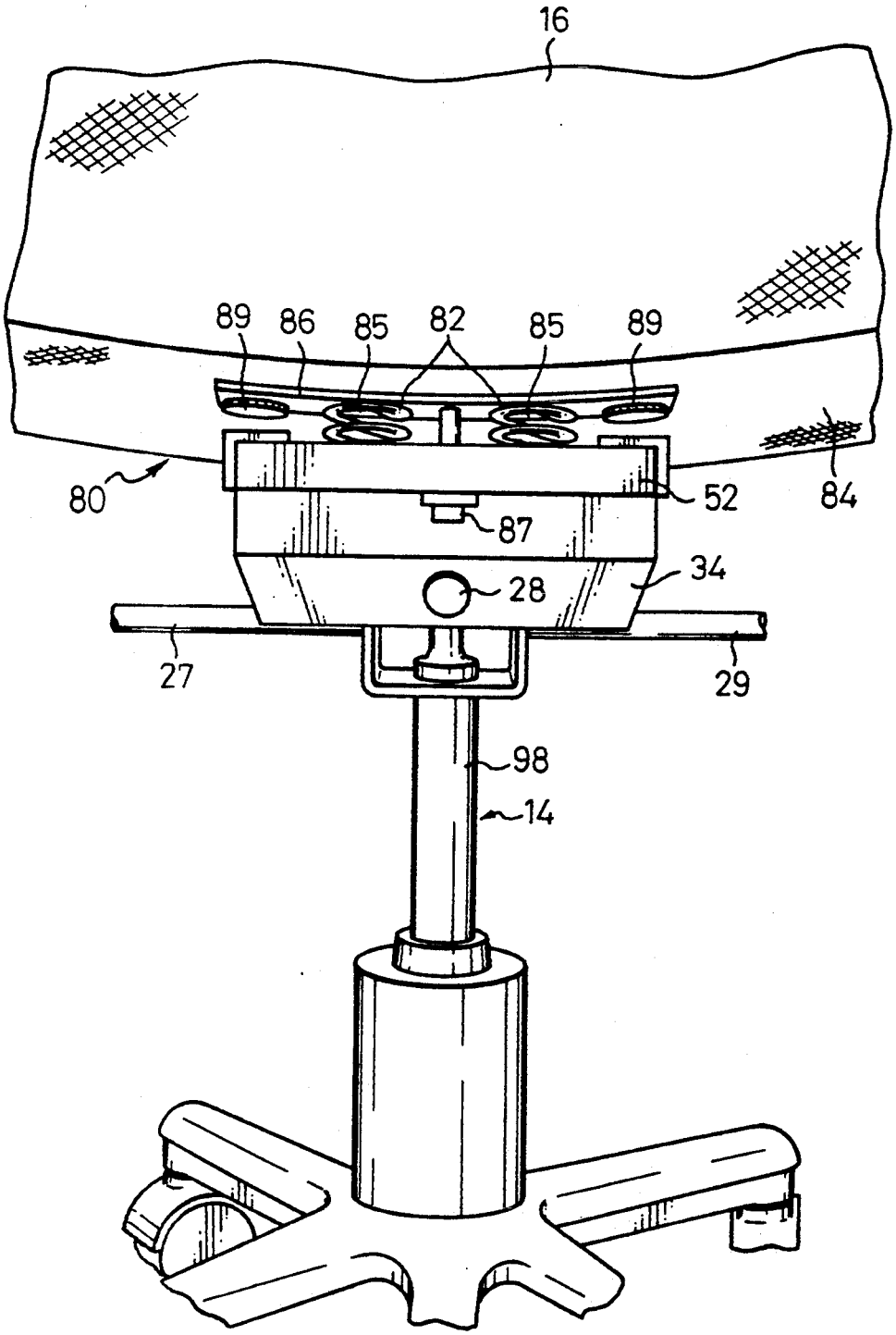
FIG. 10 is a front elevational view of a chair control mechanism embodying the present invention, showing the spring mount assembly.

Referring now to FIG. 10, a spring mount assembly 80 is shown. The spring mount assembly 80 comprises a pair of coil compression springs 82 supported in the U-shaped member 52, with one spaced at each side of the fore-and-aft centerline of the seat. The springs 82 are engaged under compression between the underside 84 of the front portion of the chair seat 16 and the U-shaped member 52 for resiliently supporting the front portion of the seat. The springs may be maintained in predetermined positions by being engaged over cylindrical projections or buttons 85 affixed to the seat in appropriate locations, as on a mounting plate 86 affixed to the seat. A retention bolt or machine screw 87 extends through a larger center opening 88 in member 52 (see FIGS. 4 and 9) and is threadably affixed to the plate 86 for maintaining the springs in compression while allowing lateral tilting of the front portion of the seat as will be noted further below. Resilient bumpers 89 also are affixed to plate 86 in vertical alignment with the top flanges of the seat support members 48 and 50 to serve as limit stops of this tilting movement.

The rear portion of the chair seat bottom 84 is bolted to the horizontal cross member 54 (shown in FIG. 8). The seat bottom 84 is made from a resiliently flexible material such as plywood to facilitate fore-and-aft, side-to-side, and diagonal tilting of the seat in concert with the user's movements. The flexure of the seat also is accommodated by rubber bushings in the attachment holes 56, 58 of bar 54, around the respective mounting bolts.

The tilt lock lever 29 shown in FIG. 10 controls the tilting capability of the chair in a known fashion. Specifically, when the tilt lock lever 29 is set in a "locked" position, the lever 29 extends through aligned holes 91 located in the flipper 40 and the housing 34, operately engaging both so as to prevent the flipper 40 and thus the seat and back from tilting with respect to the housing 34. However, when the tilt lock lever 29 is set in an "unlocked" position, the lever 29 is disengaged from these alignment holes, thus allowing the flipper 40 (and consequently the chair back and seat) to move or tilt relative to the housing 34.

Figure 11:
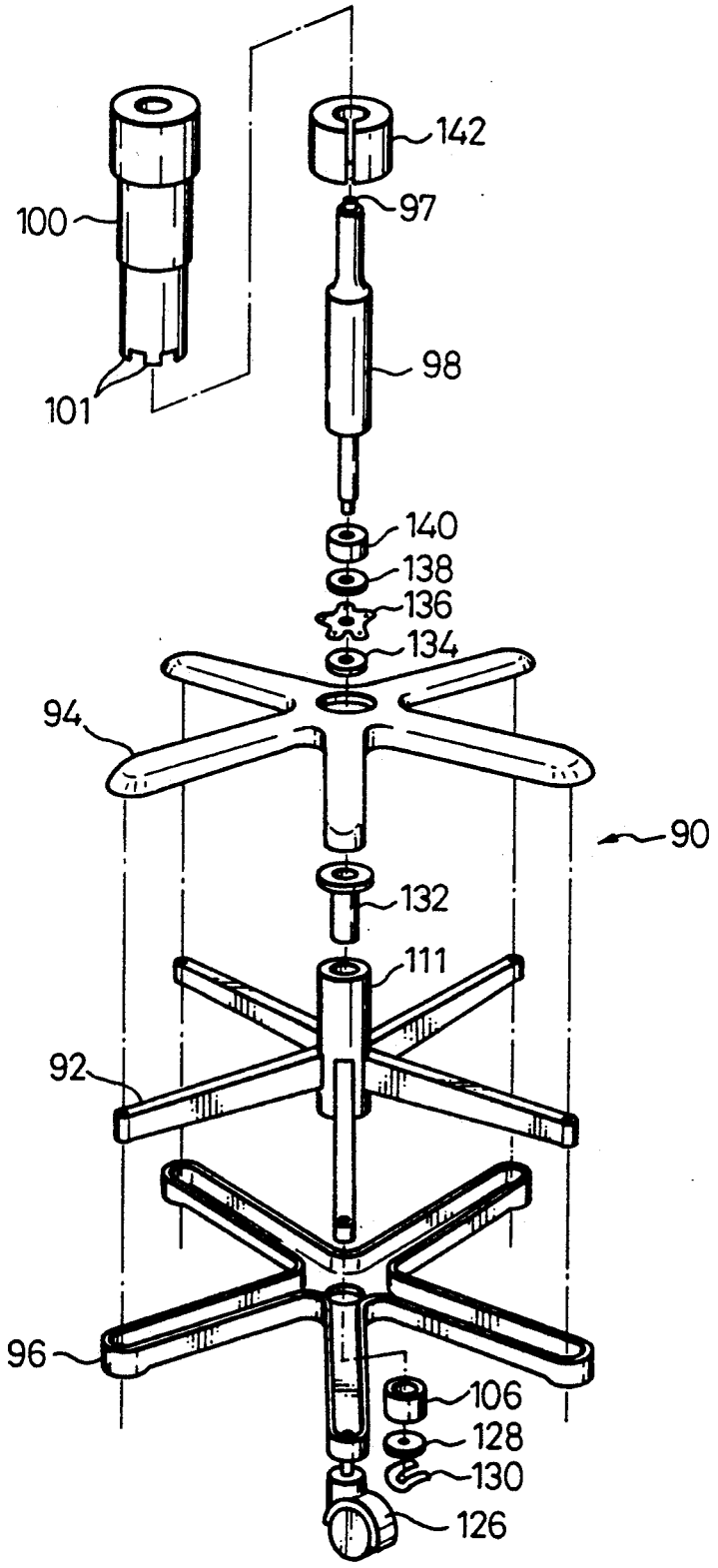
FIG. 11 is an exploded perspective view of a chair base assembly embodying the present invention.
Figure 12:
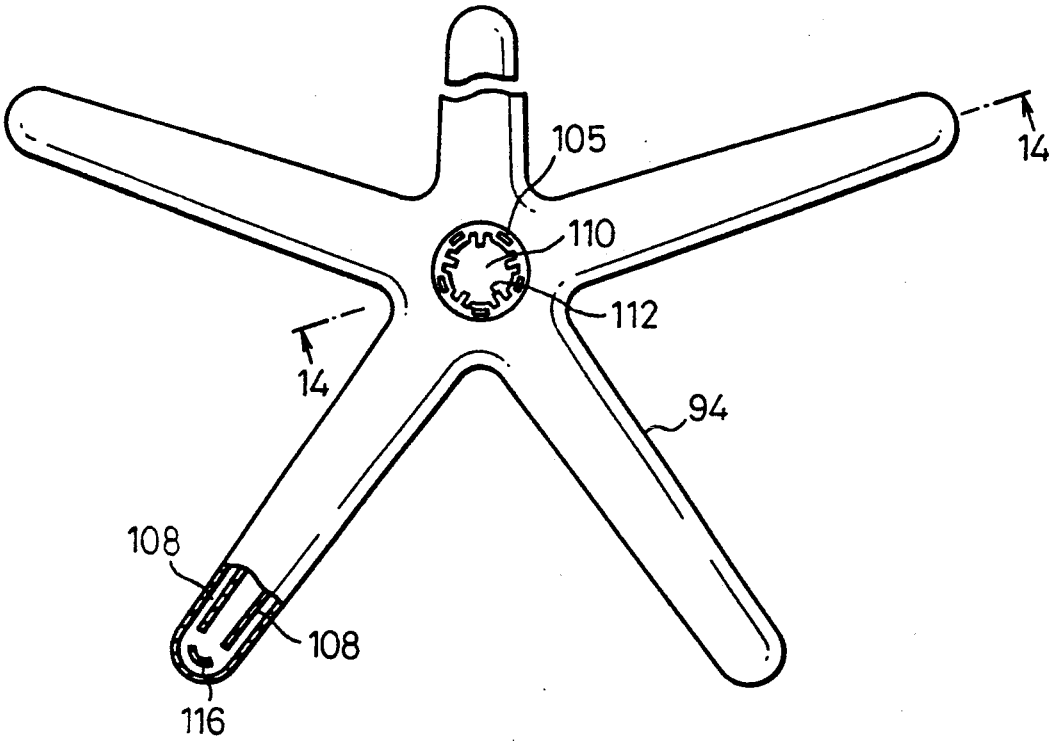
FIG. 12 is a top view of the top base cover of FIG. 11.
Figure 13:
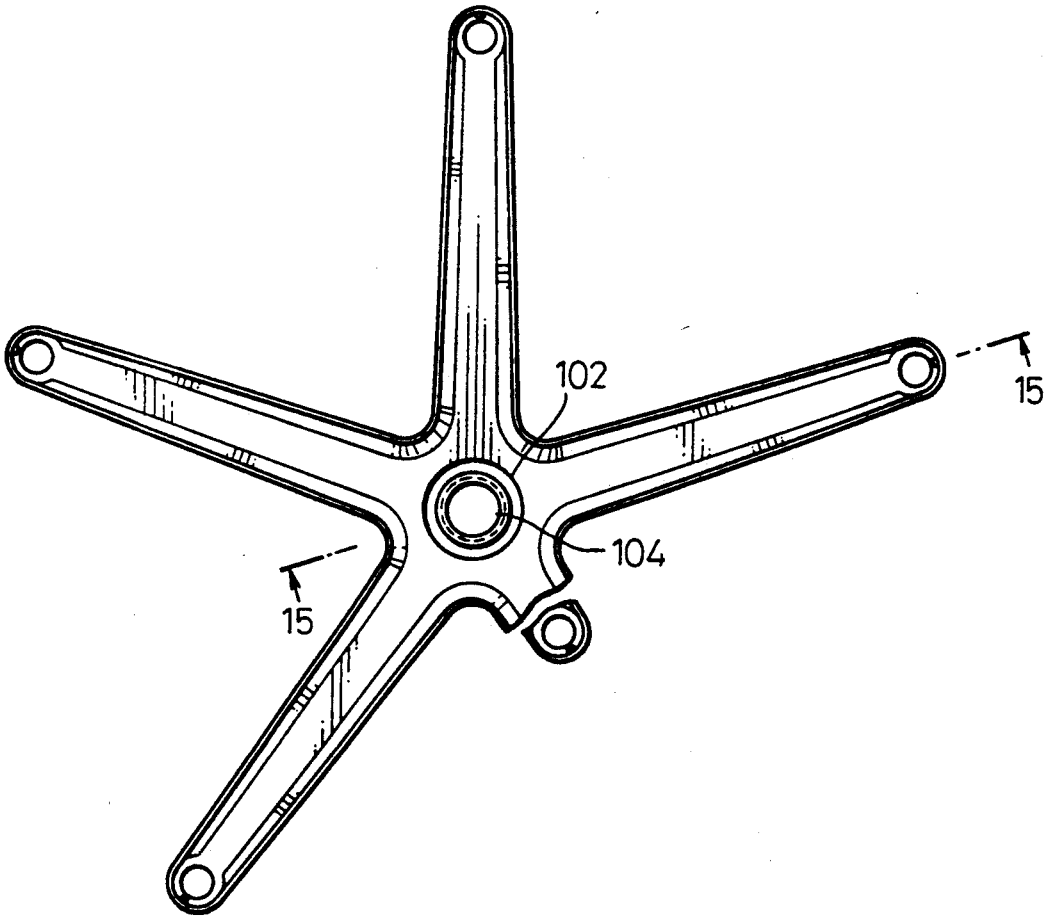
FIG. 13 is a top view of the bottom base cover of FIG. 11.
Figure 16:
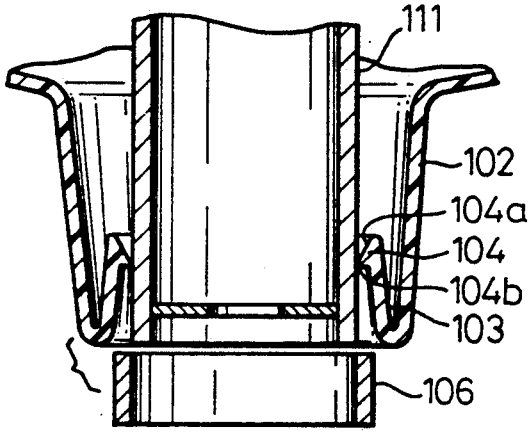
FIG. 16 is an enlarged view of the mating engagement of the bottom base cover and the base shown in FIG. 15.
Figure 17:
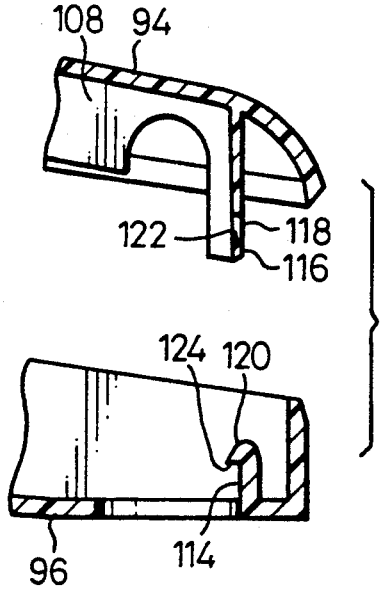
FIG. 17 is an enlarged view of the mating engagement of the top and bottom base covers shown in FIGS. 14 and 15.

FIG. 11 is an exploded elevational view of the base support assembly, designated generally as 90. The base support assembly 90 comprises a rigid multi-arm base 92 which is covered by top and bottom covers or fairings 94 and 96 respectively, a pneumatic gas cylinder 98, and a gas cylinder cover assembly 100.

As also illustrated in FIGS. 12–17, the top and bottom base covers 94, 96 are secured to the base 92 by means of a friction fit, while the covers themselves are secured to each other by means of a snap fit. When assembled, the top and bottom covers 94, 96 fully conceal the base 92, providing a selected finished appearance independent of the structural detail.

The bottom base cover 96 has a central cylindrical portion 102 which itself has a short sleeve portion 103 extending inward from its distal end and which terminates at a constricted inner gripping lip or ring 104. The ring 104 is defined by an inwardly exposed taper surface **104*a* and a radial surface 104*b*. Upon assembly, the constricted ring portion 104 provides a friction fit with the base 92. The shape of the ring 104 provides ease of assembly of the cover in force-fit relation to a cylindrical portion of the base 92 and firm retention of the bottom cover 96 on the base 92 thereafter. A bottom resilient ring 106 is then friction fitted around the bottom of the base 92, beneath the radial surface 104*b*, to help secure the base cover 96 to the base 92 by preventing the bottom base cover 96** from dropping down.

The top base cover 98 is coextensive with and fits over and forms a mating closure with the bottom cover 96. The top cover includes vertical ribs 108 which, upon assembly, fit over the arms of the base 92 to locate the cover in its correct position with respect to the base 92. The top base cover 98 has a central opening 110 for accommodating the central cylindrical portion 111 of the base 92. Upon assembly, a plurality of radially inwardly extending cantilever tabs or projections 112 engage the central cylindrical portion 111 of the base 92 in a tight friction fit for location and for retention.

The bottom base cover 96 also has an upwardly extending resilient latch tab 114 in each of its radially projecting arms. To engage these tabs 114, each arm of the top base cover 94 has a downwardly extending resilient tapered latch tongue 116 with an aperture 118 to receive the latch head 120 of the respective tab 114 and provide a shoulder 122 for abutting retentive engagement with the lateral latch surface 124 of the respective head 120. Thus, upon assembly, the tabs 114 fit within the slots of the slotted tongues 116 to form a snap fit. In the illustrated embodiment, there are five pairs of tabs and latch tongues, one pair for each of the five arms.

In the course of assembly, the top base cover 94 is fitted to the base 92 by means of a friction fit. The bottom base cover 94 is also fitted to the base 92 by means of a friction fit, while the upwardly extending latch tabs 114 engage the downwardly extending latch tongues 116 of the top base cover to form a snap fit between the top and bottom base covers. A small washer 128 fits over the shaft at the bottom of the gas cylinder assembly 98. A clip 130 engages a groove in the shaft. The resilient base ring 106 is fitted to the base 92 to help hold the bottom base cover in place. After the bottom base cover is fitted to the base, the casters 126 are put on.

A hub liner 132 fits within the central opening of the base 92. A first large washer 134, a bearing 136, a second large washer 138 and a rubber cushion 140 respectively are interposed between the hub liner 132 and the large diameter portion of the gas cylinder 98. A multi-section freely telescoping pedestal cover 100 fits over the gas cylinder 98, hiding it from view and providing an attractive appearance. Flexible snap tabs 101 in the lower end of the cover 100 engage slots 105 located around the center of the top base cover. A foam filler piece 142 is interposed between the pedestal cover 100 and the gas cylinder 98.

In operation, and referring to the schematic of FIG. 7 for simplicity, when a user leans back in a chair according to the present invention, the back support structure 38 bears down on the flipper 40 at interface C and/or the seat support structure 36 bears down on the flipper 40 at interface E, causing the flipper 40 to rotate about axis D. That is, in the tilted back position, the flipper 40 is deflected downward. As the flipper 40 is deflected downward, the seat support structure 36 is rotated about the seat pivot axis A in a predetermined relationship because of the vertical interengagement effected between the seat support structure 36 and the flipper 40 by the pin 60 in slots 61. The equal vertical movement of the flipper 40 and the rear portion of the seat at the interconnection E results in substantially greater angular movement of the flipper 40 than of the seat support 36 because of the difference in effective length of the respective radii or "links" D-E and A-E. Also, because the distance D-C substantially exceeds distance D-E (more than double) the flipper provides much greater vertical displacement of the support C than of the rear end portion of seat support 36 at E. Consequently, the back support structure 38 and hence the chair back 18 have a correspondingly greater vertical movement than the rear portion of the seat 16. In this regard, the lower back member 20 also is fixed relative to the supports 68, 70 and moves vertically therewith adjacent the rear edge of the seat 16.

The torsion spring 42 resists the rearward tilting of the chair by applying upward pressure on the flipper 40 at the location 62 where the torsion spring 42 and the flipper 40 are in contact.

The seat support structure 36, and consequently the seat 16, pivot around the seat pivot axis A. Because the seat pivot axis A is located about midway between the seat front and seat back, the seat 16 moves approximately the same distance up in front as it moves down in back.

Since the back pivot axis B is located on the seat support structure 36 forward of the seat pivot axis A, the back pivot axis B moves upward slightly as the chair seat and back are tilted rearwardly. The substantial vertical displacement at C complemented somewhat by the upward movement at B is sufficient to pivot the back support 38 about its forward pivot B with an angular displacement significantly greater than the angular displacement of the seat 36, e.g., about 1.5:1. This relationship between the chair back and the seat provides a comfortable ergonomically desirable tilt action.

A further beneficial result of this configuration and correlated angular and vertical movements is that the distance between any point on the seat and the lumbar support area of the chair back varies only slightly during these movements, thereby minimizing or eliminating the "shirt-pull" side effect.

By way of a specific example, one satisfactory design of a control mechanism 22 as seen in FIG. 2 was provided with the following approximate dimensions:

A-B=2.0 inches
A-D=2.4 inches
A-E=3.8 inches
B-C=9.0 inches

D-C=4.8 inches
D-E=1.5 inches

The spring mount assembly 80 located under the front portion of the seat 16 reduces seat tilt slightly by compressing as the front leg pressure of the user increases. In this way, the spring mount assembly reduces leg pressure caused by the upward movement of the front edge of the seat 16 as well as accommodating independent shifting movement of the user legs.

It will be appreciated that various modifications may be made to the specific design illustrated and described above. For example, the back support may be pivotally mounted directly to the housing 34. However, the illustrated embodiment is preferred for its beneficial operation and the fact that it may be implemented by relatively simple and economical modifications of proven and available controls.

Thus, there has been described a chair which meets the aforestated objects while providing a chair that is relatively easy to manufacture, comfortable to use and attractive in appearance. It will be understood that other changes in the details, arrangement of parts, and assembly procedures from those described above to explain the nature of the present invention may be made by those skilled in the art within the principle and scope of the present invention as expressed in the appended claims.

What is claimed is:

1. A chair control for a chair having a tiltable seat and a tiltable back supported on a substantially vertical pedestal, said control comprising:

a plurality of supports, including a base support, a movable back support, a movable seat support and a movable interconnection support, said base support having a forward portion corresponding to the front portion of a seat to be mounted thereon and a rear portion where a chair back is to be disposed and means for mounting said base support on such a pedestal in a predetermined orientation to horizontal, said movable back support being mounted on at least one other of said supports for pivotal movement about a generally horizontal transverse first pivot axis located forward of said mounting means, whereby said first pivot axis is disposed approximately beneath the location of the hip joint of a user when in a normal seated position on such chair, said back support including a rear portion for providing vertical support of a chair back, said movable seat support being mounted on at least one other of said supports for pivotal movement relative to said base support about a second generally horizontal transverse pivot axis, said movable seat support having a rear portion, and said movable interconnection support being mounted on said base support for pivotal movement about a generally horizontal transverse third pivot axis, said interconnection support supportably engaging said back support and said seat support and thereby effecting simultaneous coordinated angular pivotal movement of said back support and said seat support about their respective pivot axes, such engagement of said interconnection support with said back support being spaced from said first and third axes and said engagement of said interconnection support with said seat support being spaced from said second and third axes such that said angular movement of said back support significantly exceeds said angular movement of said seat support and the concomitant vertical movement of said rear portion of said back support during such angular movement substantially exceeds the vertical movement of the rear portion of a seat on said seat support during such angular movement; and a spring mounted on said supports and engaging at least one of said movable back support, said movable seat support and said movable interconnection support at a location spaced from the respective pivot axis of said one of said movable supports and thereby biasing said movable back and seat supports to the upright seating position of a back and seat when attached thereto.

2. The invention as in claim 1 wherein said movable back support is pivotally joined to said movable seat support.

3. The invention as in claim 2 wherein said second pivot axis is disposed over said mounting means to be directly over such a vertical pedestal on which said control is mounted.

4. The invention as in claim 3 wherein said movable interconnection support engages a first engagement portion of said movable back support and a second engagement portion of said movable seat support, said first engagement portion being spaced from said first axis a distance which substantially exceeds the spacing of said second engagement portion from said second pivot axis.

5. The invention as in claim 4 wherein said third pivot axis is spaced rearwardly from said second pivot axis.

6. The invention as in claim 5 wherein said spring is a torsion spring disposed about said third pivot axis and which engages said movable interconnection support in an area spaced rearwardly from said third pivot axis for the application thereto of biasing forces for biasing said movable supports to said upright position.

7. A chair control for a chair having tiltable seat and a tiltable back supported on a substantially vertical pedestal, said control comprising:

a plurality of supports, including a base support, a movable back support, a movable seat support and a movable interconnection support, said base support having a forward portion corresponding to the front portion of a seat to be mounted thereon and a rear portion where a chair back is to be disposed and means for mounting said base support on such a pedestal in a predetermined orientation to horizontal, said movable back support being mounted on at least one other of said supports for pivotal movement about a first generally horizontal transverse pivot axis located forward of said mounting means, whereby said first pivot axis is disposed approximately beneath the location of the hip joint of a user when in a normal seated position on such chair, said back support extending rearward from said first pivot axis and including a rear portion for providing vertical support of a chair back, said movable seat support being mounted on at least one other of said supports for pivotal movement about a generally horizontal transverse second pivot axis, said movable seat support extending rearward from said second pivot axis and having a rear portion, and said further movable support being pivotally mounted on said base support and supportably engaging a first engagement portion of said movable back support and a second engagement portion of said movable seat support, said first engagement portion being spaced from said first axis a distance which substantially exceeds the spacing of said second engagement portion from said second pivot axis, whereby movement of said further movable support effects simultaneous coordinated pivotal movement of said back support and said seat support about their respective pivot axes such that the angular movement of said back support significantly exceeds the angular movement of said seat support and the concomitant vertical movement of said rear portion of said back support during such angular movement substantially exceeds the vertical movement of the rear portion of a seat on said seat support during such angular movement; and a resilient biasing member mounted on said supports and engaging one of said movable back support, said movable seat support and said movable interconnection support at a location spaced from the respective pivot axis of said one of said movable supports and thereby biasing said further movable support and said back support and seat support to the upright seating position of a back and seat when attached thereto.

8. The invention as is claim 7 wherein said further movable support is connected to said base support for pivotal movement about a generally horizontal transverse third pivot axis which is spaced rearwardly from said second pivot axis.

9. The invention as in claim 8 wherein said further movable support is slidably engaged with each of said back support and said seat support and permits automatic adjustment of the point of engagement therealong as said supports pivot about their respective pivot axes.

10. The invention as in claim 9 wherein said engagement of said back support with said further movable support is adjacent one end of said further movable support.

11. The invention as in claim 10 wherein said engagement of said seat support with said further movable support is intermediate the engagement thereof with said back support and said second pivot axis.

12. The invention as in claim 8 wherein said resilient biasing member is a torsion spring disposed about said third pivot axis and which engages said further movable support in an area spaced rearwardly from said third pivot axis for the application thereto of biasing force for biasing said movable supports to said upright position.

13. In a tiltable chair having a base, a vertical pedestal supported by the base, a chair seat having a rear portion and a front portion, and a chair back, a chair control comprising:

a housing attached to said vertical pedestal in a predetermined orientation to horizontal;

a seat support structure connected to and supporting said chair seat, said seat support structure pivotally mounted on said housing for pivotal movement about a first generally horizontal transverse axis disposed over said vertical pedestal;

a back support structure connected to and supporting said chair back, said back support structure pivotally mounted on one of said housing and said seat support structure for pivotal movement about a second generally horizontal transverse axis located forward of said vertical pedestal;

a back frame member having one end portion supportably engaging said back support structure at a point spaced from said first axis, a mid-portion supportably engaging said seat support structure at a point spaced from said second axis and the other end pivotally attached to said housing for pivotal movement about a third generally horizontal transverse axis; and a resilient biasing means mounted in said housing for biasing said seat support structure, said back support structure and said back frame member to position said chair in an upright position.

14. The invention according to claim 13 further comprising means for supporting said back support structure on said back frame member, including a bearing means attached to said back support structure and engaged with said back frame member for sliding motion thereon.

15. The invention according to claim 14 wherein said back support structure comprises a pair of substantially parallel vertical members, a horizontal member interposed between said vertical members with said bearing means attached thereto, and a pair of substantially parallel horizontal extension arms fixedly attached to one end of said substantially parallel vertical members.

16. The invention according to claim 13 wherein the resilient biasing means comprises a torsion spring.

17. The invention according to claim 16 wherein said torsion spring comprises a rear portion extending substantially perpendicular to the torsional axis, said rear portion being in contact with and exerting an upward force on said back frame member.

18. The chair according to claim 13 wherein said seat support structure comprises a pair of substantially parallel horizontal members, each having a front portion and a rear portion, a U-shaped member extending between and connecting the front portions of said horizontal members, and a flat rigid horizontal cross member fixedly attached to the rear portions of said horizontal members, said horizontal cross member having holes for receiving bolts.

19. The invention according to claim 16 wherein each of said horizontal members includes a slot, said slots being located substantially laterally from one another and oriented substantially parallel to one another, said chair control further comprising an axle extending through said slots and fixedly attached to said back frame member, such that said back frame member is slidingly engaged to said seat support structure.

20. The invention according to claim 19 further comprising a spring mount assembly mounted in said U-shaped member.

21. The invention according to claim 20 wherein said spring mount assembly comprises a pair of compression springs engaged under compression between the underside of said chair seat and said U-shaped member for resiliently supporting said front portion of said chair seat.

22. The invention according to claim 13 further comprising a lower back assembly interposed between said chair back and said chair seat and attached to said back support structure.

23. The invention according to claim 14 wherein said vertical pedestal comprises a pneumatic gas cylinder for enabling the adjustment of said chair seat, said chair further comprising a lever assembly mounted on said chair control and operably engaged at one end to said pneumatic gas cylinder, and having an opposite end extending substantially radially from said pedestal, said lever assembly being of such a configuration that, when said lever assembly is in one position, said pneumatic gas cylinder is free to adjust vertically, thereby allowing the height of said chair seat to be adjusted, and when said lever assembly is in a second position, said pneumatic gas cylinder is not free to adjust vertically, thereby maintaining said chair seat at a fixed height.

24. A chair control for a chair having a tiltable seat and a tiltable back supported on a substantially vertical pedestal, said control comprising:

a plurality of supports, including a base support, a movable back support, a movable seat support and a movable interconnection support, said base support having a forward portion corresponding to the front portion of a seat to be mounted thereon and a rear portion where a chair back is to be disposed and means for mounting said base support on such a pedestal in a predetermined orientation to horizontal, said movable back support being mounted on at least one other of said supports for pivotal movement about a generally horizontal transverse first pivot axis located forward of said mounting means, whereby said first pivot axis is disposed approximately beneath the location of the hip joint of a user when in a normal seated position on such chair, said back support including a rear portion for providing vertical support of a chair back, said movable seat support being mounted on at least one other of said supports for pivotal movement about a generally horizontal transverse second pivot axis, said movable seat support having a rear portion, and said movable interconnection support being mounted on said base support for pivotal movement about a generally horizontal transverse third axis, said interconnection support supportably engaging said back support at a first distance from said third axis and engaging said seat support at a second distance from said third axis which is substantially less than said first distance and effecting simultaneous coordinated pivotal movement of said back support and said seat support about their respective pivot axes such that the angular movement of said back support significantly exceeds the angular movement of said seat support and the concomitant vertical movement of said rear portion of said back support during such angular movement substantially exceeds the vertical movement of the rear portion of a seat on said seat portion during such angular movement; and yieldable biasing means mounted on said supports and engaging at least one of said movable back support, said movable seat support and said movable interconnection support at a location spaced from the respective pivot axis of said one of said movable supports and thereby biasing said movable supports to the upright position of a back and seat when attached thereto.

25. The invention as in claim 24 and wherein said movable interconnection support extends rearward from said third axis.

26. The invention as in claim 25 and wherein said movable interconnection support slidably engages said rearward portions of said back support and said seat support.

27. The invention as in claim 24 and wherein the ratio of said first distance to the distance between said first pivot axis and the engagement of said interengagement support with said back support exceeds the ratio of said second distance to the distance between said second pivot axis and the engagement of said interengagement support with said seat support.

28. The invention as in claim 27 and wherein said movable interconnection support extends rearward from said third axis.

29. The invention as in claim 28 and wherein said movable interconnection support slidably engages said rearward portions of said back support and said seat support.

30. The invention as in claim 24 and wherein said yieldable biasing means is a coil spring.

31. The invention as in claim 30 wherein said coil spring is disposed about said third axis.

* * * * *